US007032414B2

(12) United States Patent
Lonati et al.

(10) Patent No.: US 7,032,414 B2
(45) **Date of Patent: *Apr. 25, 2006**

(54) THREAD GRIPPING DEVICE, PARTICULARLY FOR GRIPPING ELASTIC THREADS HAVING A SMALL CROSS-SECTION, IN CIRCULAR KNITTING MACHINES FOR HOSIERY OR THE LIKE

(75) Inventors: Francesco Lonati, deceased, late of Brescia (IT); by Ettore Lonati, legal representative, Brescia (IT); Fausto Lonati, Brescia (IT); Tiberio Lonati, Brescia (IT)

(73) Assignee: Santoni S.p.A., Brescia (IT)

( * ) Notice: Subject to any disclaimer, the term of this patent is extended or adjusted under 35 U.S.C. 154(b) by 31 days.

This patent is subject to a terminal disclaimer.

(21) Appl. No.: 10/498,483

(22) PCT Filed: Dec. 17, 2002

(86) PCT No.: PCT/EP02/14424

§ 371 (c)(1),
(2), (4) Date: Jun. 14, 2004

(87) PCT Pub. No.: WO03/054262

PCT Pub. Date: Jul. 27, 2003

(65) Prior Publication Data

US 2005/0066692 A1 Mar. 31, 2005

(30) Foreign Application Priority Data

Dec. 21, 2001 (IT) ..... MI2001A2775

(51) Int. Cl.
*D04B 15/60* (2006.01)

(52) U.S. Cl. ..... 66/145 R; 66/134; 66/140 R; 66/142

(58) Field of Classification Search ..... 66/125 R, 66/134, 139, 140 R, 145 R, 142
See application file for complete search history.

(56) References Cited

U.S. PATENT DOCUMENTS 3,598,158 A * 8/1971 Hall ..... 139/263
3,803,878 A * 4/1974 Lonati ..... 66/14

(Continued)

FOREIGN PATENT DOCUMENTS

DE C-41 31 021 12/1992

(Continued)

OTHER PUBLICATIONS

Patent Abstracts of Japan vol. 1997, No. 06, Jun. 30, 1997—& JP 09 031808 A (Tsudakoma Corp), Feb. 4, 1997 abstract; figures 1, 2.

*Primary Examiner*—Danny Worrell
(74) *Attorney, Agent, or Firm*—Guido Modiano; Albert Josif; Daniel O'Byrne

(57) ABSTRACT

A thread gripping device, for gripping elastic thin thread, in a circular knitting machines, having a supporting element that supports thread guides proximate to a drop or feed, above the needle cylinder and proximate to the needle work area, and bearing at least one elastic lamina element and a thread locking lever pivoted to the supporting element and to rotate scissor-like to catch the thread with a grip portion between the locking lever and the elastic lamina element. The thread gripping region of the locking lever is made of a material with higher friction coefficient, than the remaining part of the locking lever.

15 Claims, 2 Drawing Sheets

U.S. PATENT DOCUMENTS

| | | | | |
|---|---|---|---|---|
| 4,967,575 | A * | 11/1990 | Fucik et al. | 66/14 |
| 5,070,709 | A * | 12/1991 | Guell | 66/140 R |
| 6,000,245 | A * | 12/1999 | Plath et al. | 66/139 |
| 6,189,345 | B1 * | 2/2001 | Sangiacomo | 66/134 |

FOREIGN PATENT DOCUMENTS

| | | |
|---|---|---|
| EP | A-1 059 376 | 12/2000 |
| GB | A-2 142 660 | 1/1985 |

* cited by examiner

THREAD GRIPPING DEVICE, PARTICULARLY FOR GRIPPING ELASTIC THREADS HAVING A SMALL CROSS-SECTION, IN CIRCULAR KNITTING MACHINES FOR HOSIERY OR THE LIKE

TECHNICAL FIELD

The present invention relates to a thread gripping device, particularly for gripping elastic threads having a small cross-section, in circular knitting machines for hosiery or the like.

BACKGROUND ART

In circular knitting machines for hosiery or the like, at the end of a knitting process performed with the thread dispensed by a corresponding thread guide at a feed or drop of the machine, the thread guide is moved into a position in which it prevents the needles from engaging the thread and the thread is cut.

The portion of thread that lies between the corresponding thread guide and the end formed by the cut is kept in a position that allows to resume knitting with that thread.

Generally, thread guides are arranged around the needle cylinder just above its upper end, and in order to prevent the needles from engaging the thread the thread dispensing end of said thread guides is raised.

At the upper end of the needle cylinder, just below the dispensing end of the thread guides, when such end is lowered to feed the thread to the needles, there is a circular cutter, which is arranged coaxially to the needle cylinder and has a slightly smaller diameter than the cylindrical surface traced by the needles as a consequence of the rotary motion of the needle cylinder about its own axis. Said cutter is provided with a plurality of teeth and generally rotates at the same speed as the needle cylinder. When a thread guide is raised in order to prevent the needles from engaging the thread and the needles that have engaged said thread are lowered into the needle cylinder, the portion of thread that lies between the thread guide and the last needle that engaged said thread is engaged by a tooth of the cutter and is drawn until said tooth of the cutter encounters a fixed abutment or blade, which cuts the thread.

In the region between the thread guide and the blade, above the needle cylinder, within the cylindrical surface traced by the needles, there is an aspirator port. In practice, the portion of thread that lies between the corresponding thread guide and the tooth of the cutter that has engaged it, before cutting, is placed below the aspirator port, so that after cutting the cut end of said thread portion is aspirated into the aspirator port. In this manner, the portion of thread that lies between the thread guide and the cut end is retained and kept tensioned, so that when the corresponding thread guide is lowered again said portion of thread descends between two contiguous needles, ensuring that said thread is engaged correctly by the first needle that is moved to knit at the feed being considered in order to knit with said thread.

When the thread is elastically extensible and is fed in a pre-tensioned condition, the retention performed by the aspirator port may be insufficient, and the thread, after cutting, might contract and return toward the dispensing end of the thread guide due to elastic reaction, to the point of sliding out of said thread guide, making it impossible to subsequently resume knitting with that thread.

In these cases, and possibly in the case of particular knitting requirements, downstream of the thread guides of a feed along the direction of rotation of the needle cylinder with respect to the thread guides there are thread gripping devices, which are designed to perform a firmer and more reliable retention of the thread when it is cut.

One of the thread gripping devices currently used in circular knitting machines or hosiery knitting machines comprises a supporting element, which is fixed to the structure of the machine that supports the thread guides proximate to a feed or drop. Said supporting element supports at least one elastic lamina element and a thread locking lever, which is pivoted to the supporting element and can rotate in a scissor-like fashion with respect to the elastic lamina element in order to catch the thread directly before it is cut and grip it between the locking lever and the elastic lamina element.

The locking lever and the elastic lamina element are arranged on planes that are substantially radial with respect to the needle cylinder and are located above the needle cylinder.

The locking lever has, on its lower side, which faces the upper end of the needle cylinder, a lug that forms a shoulder that is directed toward the axis of the needle cylinder.

In order to grip the thread, the locking lever is turned about its own pivoting axis, on its plane of arrangement, which lies substantially radially with respect to the needle cylinder, so that its lower end moves transversely to the path of the thread in order to engage said thread by means of said shoulder and move the thread toward the axis of the needle cylinder and grip it between said locking lever and the elastic lamina element.

In the use of these devices, a certain difficulty has been observed in gripping and retaining small-diameter elastically extensible threads that are fed in a pre-tensioned condition.

In this case, the locking lever and the elastic lamina element are in fact unable to ensure correct gripping of the thread, since said thread, owing to its small diameter and to the tension to which it is subjected, tends to escape from the grip of the locking lever and of the elastic lamina element and to return toward the dispensing end of the thread guide that dispenses it.

An event of this kind is a significant problem, since the thread might slide out of the thread guide and therefore become unavailable when knitting with that thread resumes. In this case, the manual intervention of an operator is required in order to reinsert the thread in the thread guide. If the operator is not available immediately, the machine stops, with a consequent production loss.

On the other hand, the thrust of the elastic lamina element against the locking lever cannot be increased beyond a certain limit without the danger of damaging the thread.

DISCLOSURE OF THE INVENTION

The aim of the present invention is to solve the problem described above, by providing a thread gripping device in circular knitting machines for hosiery or the like that ensures correct gripping of the thread even in the case of small-diameter elastic threads fed in a pre-tensioned condition.

Within this aim, an object of the invention is to provide a device that avoids damage to the thread during gripping.

Another object of the invention is to provide a device that can be installed in a simple manner on a wide range of circular knitting machines for hosiery or the like.

This aim and these and other objects that will become better apparent hereinafter are achieved by a thread gripping device in circular knitting machines for hosiery or the like, comprising a supporting element that can be fixed to the structure of the machine that supports the thread guides proximate to a drop or feed, above the needle cylinder and proximate to the needle work area, said supporting element bearing at least one elastic lamina element that is arranged on a plane that lies substantially radially with respect to the needle cylinder, said supporting element furthermore supporting a thread locking lever that is pivoted to said supporting element with one of its portions and has a pivoting axis that is orientated substantially at right angles to the plane of arrangement of said elastic lamina element, said locking lever being laterally adjacent to said elastic lamina element and having a grip portion that can engage the thread dispensed by at least one thread guide at the corresponding feed or drop, actuation means being provided for actuating said locking lever for its scissor-like rotation with respect to said elastic lamina element about said pivoting axis for the passage of said locking lever from an inactive position, in which said thread grip portion is spaced from said elastic lamina element in the opposite direction with respect to the axis of the needle cylinder, to an active position, in which said thread grip portion is closer to said elastic lamina element and laterally superimposed thereon, in order to grip the thread between said elastic lamina element and said locking lever, or vice versa, characterized in that the region of said locking lever that is in contact with the thread during gripping is made of a material that has a higher friction coefficient, in relation to the thread to be gripped, than the remaining part of said locking lever.

BRIEF DESCRIPTION OF THE DRAWINGS

Further characteristics and advantages of the invention will become better apparent from the description of a preferred but not exclusive embodiment of the device according to the invention, illustrated only by way of non-limitative example in the accompanying drawings, wherein.

WAYS OF CARRYING OUT THE INVENTION

Figure 1:
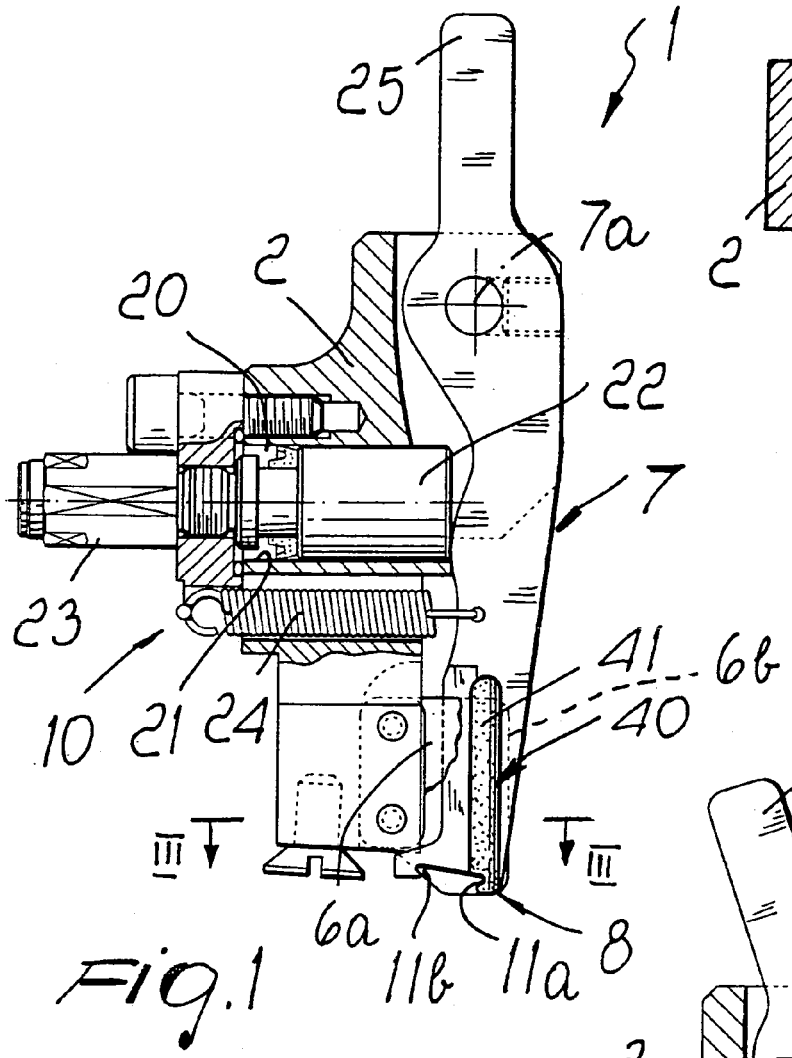
FIG. 1 is a partially sectional side elevation view of the device according to the invention, with the locking lever in the active position.
Figure 3:
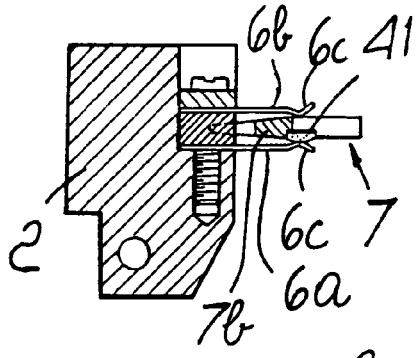
FIG. 3 is a sectional view of FIG. 1, taken along the line III—III.

With reference to the figures, the device according to the invention, generally designated by the reference numeral 1, comprises a supporting element 2, which can be fixed to the structure of the machine that supports the thread guides 3, proximate to a drop or feed, above the needle cylinder 4 and proximate to the needle work area 5.

The supporting element 2 supports at least one elastic lamina element 6*a* and 6*b*, which is arranged on a plane that is substantially radial with respect to the needle cylinder 4. The supporting element 2 further supports a thread locking lever 7, which is pivoted to the supporting element 2, with one of its portions, about a pivoting axis 7*a*, which is substantially perpendicular to the plane of arrangement of the elastic lamina element 6*a* and 6*b*.

The locking lever 7 is laterally adjacent to the elastic lamina element 6*a* and 6*b* and has a grip portion 8, which can engage the thread 9 dispensed at the corresponding feed or drop of the machine.

Figure 2:
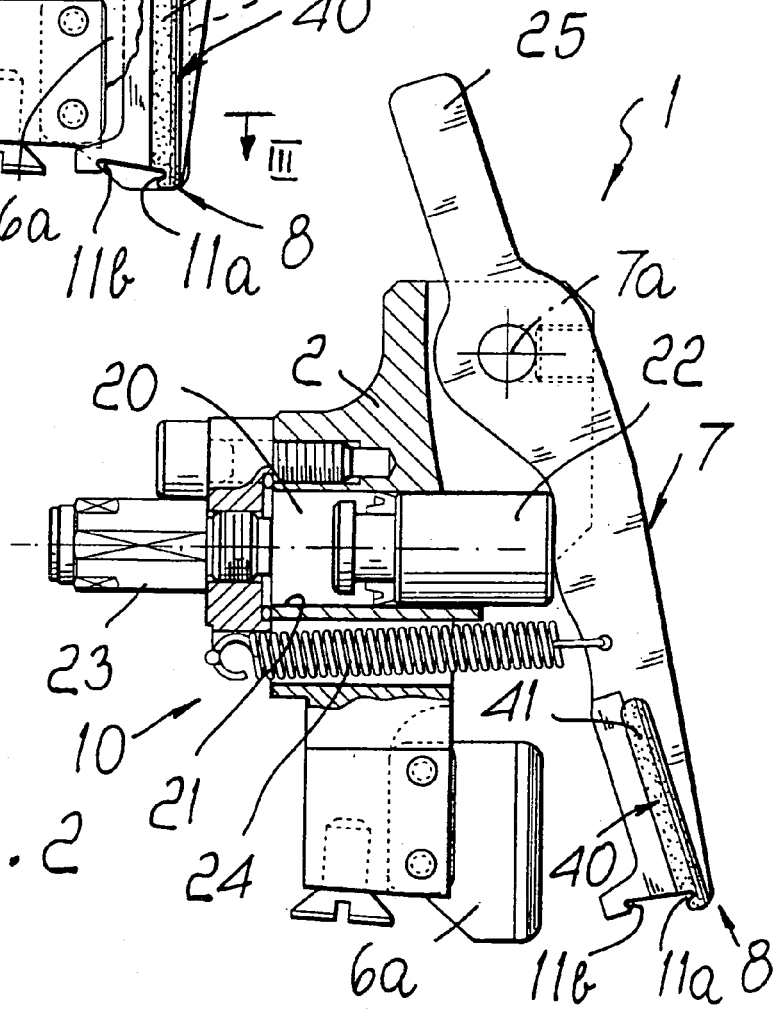
FIG. 2 is a view, similar to FIG. 1, of the device according to the invention, with the locking lever in the inactive position.
Figure 4:
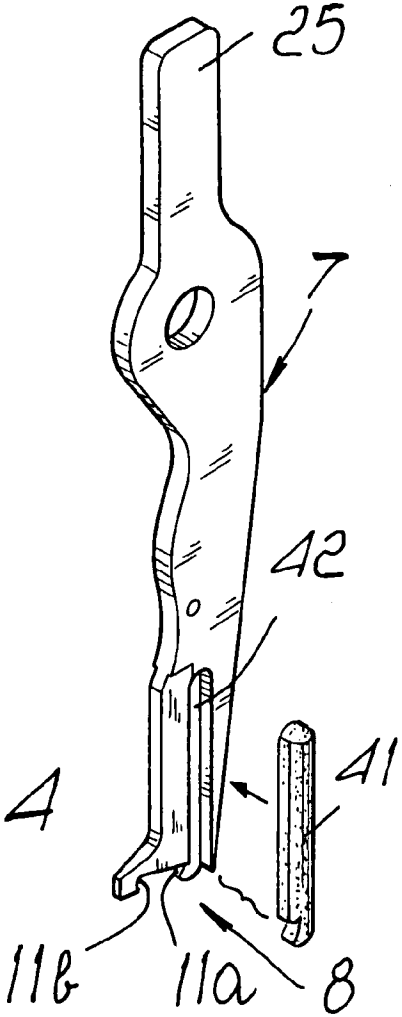
FIG. 4 is an exploded perspective view of the locking lever.

The device comprises means 10 for actuating the locking lever 7 in order to produce its scissor-like rotation, with respect to the elastic lamina element 6*a* and 6*b*, about the pivoting axis 7*a* for the passage of the locking lever 7 from an inactive position, shown in FIG. 2, in which the grip portion 8 of the locking lever 7 is moved away from the elastic lamina element 6*a* and 6*b* in the opposite direction with respect to the axis of the needle cylinder 4, to an active position, in which said grip portion 8 is closer to, and laterally superimposed on, the elastic lamina element 6*a* and 6*b*, in order to grip the thread 9 between the elastic lamina element 6*a* and 6*b* and the locking lever 7 and vice versa.

Advantageously, the grip portion 8 has two opposite shoulders 11*a* and 11*b*, which delimit bilaterally the movement of the thread 9 toward or away from the axis of the needle cylinder 4.

Preferably, instead of a single elastic lamina element, which might be constituted by the elastic lamina element 6*a*, there are two elastic lamina elements 6*a* and 6*b*, which are arranged side by side and can flex elastically toward or away from each other.

The locking lever 7, in passing from the inactive position to the active position, wedges itself at least with the grip portion 8 between the pair of elastic lamina elements 6*a* and 6*b*.

At least the portion of the locking lever 7 that is meant to wedge itself between the pair of elastic lamina elements 6*a* and 6*b* is flat, and at least the region (7*b*) thereof meant to be the first to penetrate between the elastic lamina elements 6*a* and 6*b* in passing from the inactive position to the active position is wedge-shaped.

Conveniently, the side of the pair of elastic lamina elements 6*a* and 6*b* that is directed toward the locking lever 7 in the inactive position is bent so as to form a guiding flared portion (6*c*) for the wedging (7*b*) of the locking lever 7 between the pair of elastic lamina elements 6*a* and 6*b*.

According to the invention, the region 40 of the locking lever 7 that is in contact with the thread 9 while it is gripped is made of a material that has a higher friction coefficient, in relation to the thread 9 to be gripped, than the remaining part of the locking lever 7.

Conveniently, said material is constituted by an elastically deformable material, preferably natural or synthetic rubber.

The region 40 is preferably formed by an insert 41, made of said material, which is applied to the body of the locking lever 7 at an appropriately provided recess 42 formed in the side of the locking lever 7 that cooperates with the elastic lamina element 6*a* in gripping the thread 9.

The insert 41 protrudes slightly from said side of the locking lever, and its surface that protrudes from the side of the locking lever 7 is conveniently blended with the surface of said side of the locking lever 7.

It should be noted that the insert 41 is limited only to the region of the locking lever 7 that makes contact with the elastic lamina element 6*a* when the thread 9 is gripped, so as to limit the extent of the sliding of the insert 41 against the elastic lamina element 6*a* and therefore limit the wear of the insert 41.

Preferably, the insert 41 also covers the region in which the shoulder 11*a* is formed.

The device is meant to be mounted above the needle cylinder 4, so that the lower side of the locking lever 7, on which the shoulders 11*a* and 11*b* are formed, lies above the circular cutter 12 usually provided in circular knitting machines or hosiery knitting machines, and the elastic lamina elements 6*a* and 6*b* lie within the cylindrical surface traced by the needles 5 as a consequence of the rotation of the needle cylinder about its own axis.

The locking lever 7, in the inactive position shown in FIG. 2, is arranged so that the region located between the shoulders 11*a* and 11*b* lies at the path of the thread 9 at the end of its feeding to the needles 5 of the machine, as will become better apparent hereinafter.

The rotation of the locking lever 7 about the pivoting axis 7*a*, in passing from the inactive position to the active position or vice versa, occurs on a plane that is substantially radial with respect to the needle cylinder 4, so that the lower end of the locking lever 7, on which the shoulders 11*a* and 11*b* are formed, moves transversely to the path followed by the thread 9 during its feeding to the needles 5 of the machine.

Conveniently, the shoulders 11*a* and 11*b* have an undercut region, which forms a receptacle for retaining the thread 9 so as to assuredly prevent the thread from exiting from the region of the locking lever 7 that is indeed delimited by the shoulders 11*a* and 11*b*.

In positioning the device on the machine, the axis 7*a* for pivoting the locking lever 7 to the supporting element 2 is arranged above the region of mutual lateral overlap of the locking lever 7 with the elastic lamina elements 6*a* and 6*b*.

The actuation means 10 comprise a pneumatic cylinder 20, which is connected to, or integrated with, the supporting element 2.

In the illustrated embodiment, the pneumatic cylinder 20 is formed directly within the supporting element 2. More particularly, in the supporting element 2 there is a cylindrical chamber 21, which slidingly accommodates a piston 22, which acts on a region of the locking lever 7 that lies between the pivoting axis 7*a* and the elastic lamina elements 6*a* and 6*b*.

The chamber 21 has an opening that is connected to a supply connector 23, which can be connected selectively to a compressed air line or to a vent in order to produce the translational motion of the piston 22 toward the locking lever 7 or to allow the sliding of the piston 22 in the opposite direction, in a per se known manner.

The passage of the locking lever 7 from the active position to the inactive position, performed by virtue of the actuation of the pneumatic cylinder 20, is contrasted by elastic means, constituted by a spring 24 in which one end is connected to the supporting element 2 and the opposite end is connected to the locking lever 7.

According to requirements, the device according to the invention can be arranged proximate to the thread guides 3, as shown, or proximate to the thread aspirator port, if provided, which is usually provided in circular knitting machines for hosiery or the like.

For the sake of completeness in description, it should be noted that the locking lever 7 has, on the opposite side with respect to its lower end, in which the shoulders 11*a* and 11*b* are provided, an extension 25 that protrudes upward from the supporting element 2 in order to allow, if required, the manual actuation of the locking lever 7.

Figure 5:
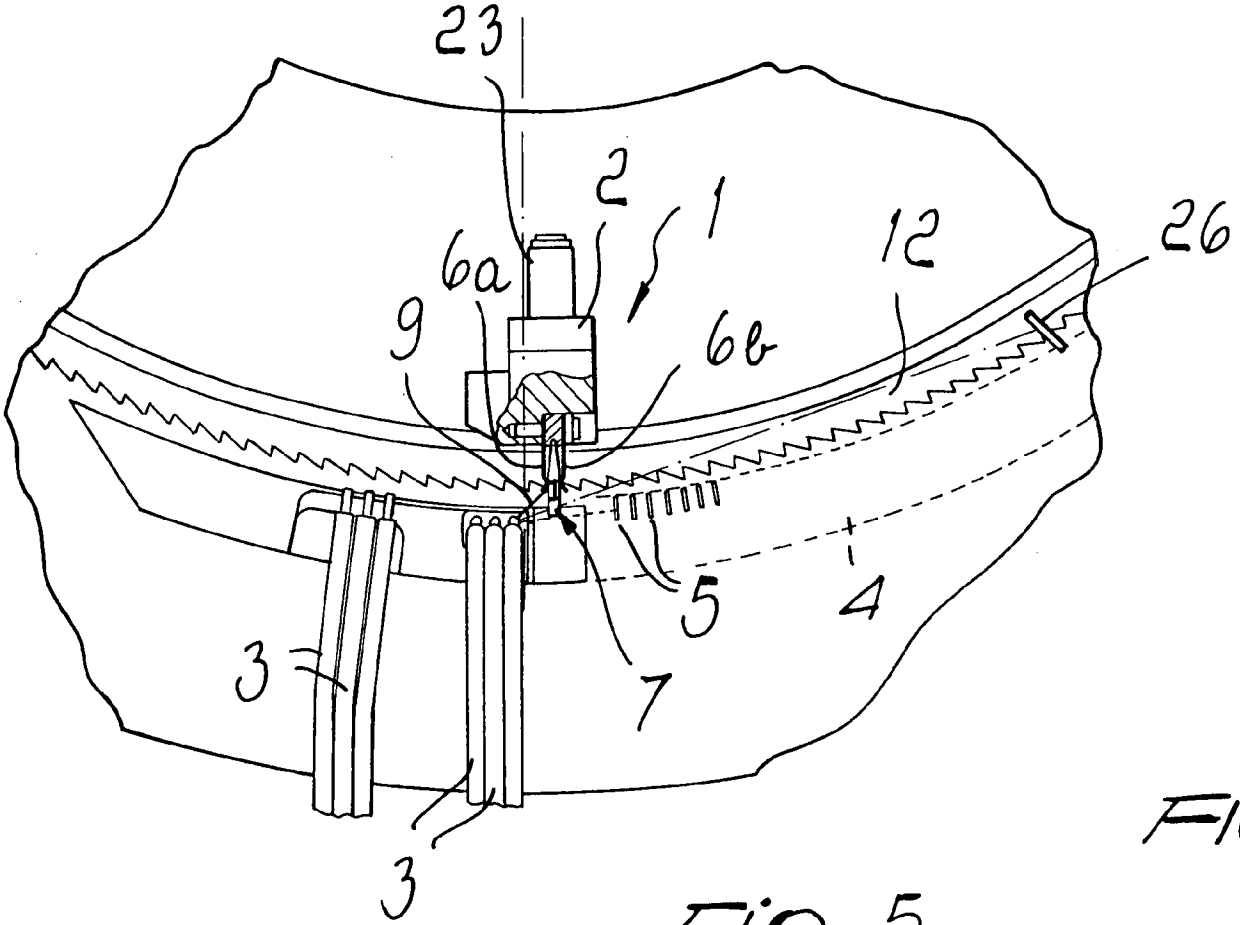
FIG. 5 is a sectional view, similar to FIG. 3, of the device according to the invention, applied above the needle cylinder of a circular knitting machine or hosiery knitting machine, shown only schematically for the sake of simplicity.

Furthermore, with reference to FIG. 5, downstream of the thread guides 3 along the direction of rotation of the needle cylinder 4 about its own axis there is, in a per se known manner, a blade 26 that cooperates with the teeth of the cutter 12 in cutting the thread 9.

Operation of the device according to the invention is as follows.

During the feeding of the thread 9 to the needles 5, the corresponding thread guide 3 is lowered toward the needles 5 or in any case in a position that allows the needles 5 of the machine to engage the thread 9. In this operating condition, the locking lever 7 can be in the active position, shown in FIG. 1, or in the inactive position, shown in FIG. 2.

If the locking lever 7 is in the active position, before the end of the step for feeding the thread 9, i.e., before lifting the thread guide 3, the locking lever 7 is moved into the inactive position, shown in FIG. 2. At the end of the step for feeding the thread 9, the thread guide 3 is raised or otherwise moved into a position that prevents the needles 5 from engaging the thread, and the thread 9 remains engaged with the last needle fed. The portion of thread 9 that lies between the thread guide 3 and the last needle that engaged it, as a consequence of the movement of the thread guide 3 and of the traction performed by said needle, rises and moves toward the axis of the needle cylinder 4, arranging itself in the space of the locking lever 7 that is delimited by the shoulders 11*a* and 11*b*, which limit the possibility of lateral movements of the thread 9. In particular, the shoulder 11*b*, which is directed away from the axis of the needle cylinder 4 and is located between the axis of the needle cylinder 4 and the thread 9, limits, during this step, the possibility of movement of the thread 9 toward the axis of the needle cylinder 4.

The portion of thread 9 that lies between the thread guide 3 and the last needle that engaged it is caught by a tooth of the cutter 12, which gradually draws it toward the blade 26. Just before the thread 9 undergoes the cutting action of the blade 26, the pneumatic cylinder 20 is discharged, so that by virtue of the action of the spring 24 the locking lever 7 is rotated about the pivoting axis 7*a*, passing from the inactive position to the active position, i.e., moving with its lower end toward the axis of the needle cylinder 4. As a consequence of this movement of the locking lever 7, the shoulder 11*a* engages the thread 9 and draws it between the elastic lamina elements 6*a* and 6*b*. The thread 9 is thus gripped between the locking lever 7 and the elastic lamina elements 6*a* and 6*b*. In particular, the thread is gripped between the elastic lamina element 6*a* and the locking lever 7.

More particularly, the thread 9 is gripped between the region of the locking lever 7 at which the insert 41 is located and the elastic lamina element 6*a*. By way of the high friction and the deformability ensured by the insert 41, the thread 9 is retained with absolute assurance even if the thread 9 is constituted by an elastic thread that has a small diameter and is fed in a pre-tensioned condition, and even if the elastic lamina element 6*a* is not perfectly parallel to the grip portion 8 of the locking lever 7.

When one wishes to resume knitting with the thread retained by the locking lever 7, the thread guide 3 is moved again into a position that is suitable to allow the thread 9 to be gripped by the needles 5, and the locking lever 7 is returned, by way of the actuation of the pneumatic cylinder 20, to the inactive position, in contrast with the action of the spring 24.

In practice it has been found that the device according to the invention fully achieves the intended aim and objects, since it is capable of ensuring effective gripping of elastic threads that have a small diameter. In particular, the insert made of elastically deformable material on the locking lever ensures effective gripping of small-diameter elastic threads even if said threads are fed in a pre-tensioned condition and even if the elastic lamina element that cooperates with it in gripping has slight anomalies in terms of positioning or shape, without causing damage to the thread.

Furthermore, the device according to the invention, by avoiding abnormal movements of the thread toward the axis of the needle cylinder of the machine in the step in which feeding ends and thread engagement begins, is capable of gripping the thread with absolute assurance during its cutting.

Although the device according to the invention has been conceived in particular for gripping small-diameter elastic threads that are fed in a pre-tensioned condition, it can nonetheless also be used for other kinds of thread.

The device thus conceived is susceptible of numerous modifications and variations, all of which are within the scope of the appended claims; all the details may further be replaced with other technically equivalent elements.

In practice, the materials used, as well as the dimensions, may be any according to requirements and to the state of the art.

The disclosures in Italian Patent Application No. MI2001A002775 from which this application claims priority are incorporated herein by reference.

What is claimed is:

1. A thread gripping device in a circular knitting machine with a structure and a needle cylinder with needles, comprising: a supporting element fixable to the structure of the machine that supports thread guides proximate to a drop or feed of the machine, above the needle cylinder and proximate to a needle work area, said supporting element being provided with and bearing at least one elastic lamina element that is arranged on a plane that lies substantially radially with respect to the needle cylinder, and being furthermore provided with and supporting a thread locking lever pivoted thereto with a portion thereof said supporting element having a pivoting axis that is orientated substantially at right angles to a plane of arrangement of said elastic lamina element, said locking lever being laterally adjacent to said elastic lamina element and having a grip portion for engaging the thread dispensed by at least one thread guide at the corresponding feed or drop of the machine; actuation means for actuating said locking lever for scissor-like rotation thereof with respect to said elastic lamina element about said pivoting axis and for passage of said locking lever from an inactive position, in which said thread grip portion is spaced from said elastic lamina element in an opposite direction with respect to an axis of the needle cylinder, to an active position, in which said thread grip portion is closer to said elastic lamina element and laterally superimposed thereon, in order to grip thread between said elastic lamina element and said locking lever, and vice versa; and wherein a region of said locking lever that is in contact with thread during gripping is made of a material that has a higher friction coefficient, in relation to the thread to be gripped, than a remaining part of said locking lever.

2. The device of claim 1, wherein said material is constituted by an elastically deformable material.

3. The device of claim 2, wherein said elastically deformable material is constituted by rubber.

4. The device of claim 1, wherein said region of the locking lever that is in contact with the thread during gripping is formed by an insert that is applied to the body of said locking lever at a recess formed on the side of said locking lever which cooperates with said elastic lamina element in gripping the thread, said insert protruding from said side of the locking lever.

5. The device of claim 4, wherein the surface of said insert that protrudes from said side of the locking lever is blended with a side of said locking lever.

6. The device of claim 4, wherein said material or insert is limited to a region of said locking lever that makes contact with said elastic lamina element upon thread gripping.

7. The device of claim 1, wherein said thread grip portion has two mutually opposite shoulders, which delimit bilaterally movement of the thread toward or away from the axis of the needle cylinder.

8. The device of claim 7, comprising two elastic lamina elements that are arranged side by side and are elastically flexible toward and away from each other, said locking lever, in passing from said inactive position to said active position, is adapted for wedging with at least said thread grip portion between said pair of elastic lamina elements.

9. The device of claim 8, wherein at least a portion of said locking lever adapted for wedging between said pair of elastic lamina elements is flat.

10. The device of claim 9, wherein said portion of said locking lever adapted for wedging between said pair of elastic lamina elements is wedge-shaped, and wherein a side of said pair of elastic lamina elements that is directed toward said locking lever in said inactive position is bent so as to form a flared portion for guiding wedging of said locking lever between said pair of elastic lamina elements.

11. The device of claim 8, wherein said thread grip portion of said locking lever is formed on the lower side of said locking lever that faces a top region of the needle cylinder.

12. The device of claim 8, wherein the axis about which said locking lever is pivoted to said supporting element is arranged above a region of mutual lateral overlap of said elastic lamina elements with respect to said locking lever.

13. The device of claim 12, wherein said mutually opposite shoulders have an undercut region that forms a receptacle for retaining the thread.

14. The device of claim 1, comprising: elastic return means that connect said locking lever to said supporting element, wherein said actuation means comprising a pneumatic cylinder, which is connected to said supporting element and has a piston, said pneumatic cylinder acting with the piston on a region of said locking lever in order to pass from said active position to said inactive position in contrast with said elastic return means.

15. The device of claim 4, wherein the region for gripping the thread between said locking lever and said at least one elastic lamina element is arranged between a cylindrical surface along which the needles are arranged in the needle cylinder and the axis of the needle cylinder.

* * * * *